United States Patent [19]

Storandt

[11] Patent Number: 5,019,058

[45] Date of Patent: May 28, 1991

[54] APPLICATOR MITT

[76] Inventor: Duane L. Storandt, P.O. Box 6813, St. Louis, Mo. 63144

[21] Appl. No.: 212,503

[22] Filed: Jun. 28, 1988

Related U.S. Application Data

[63] Continuation-in-part of Ser. No. 9,053, Jan. 27, 1987, abandoned.

[51] Int. Cl.[5] ..... A61M 35/00

[52] U.S. Cl. ..... 604/290; 604/289

[58] Field of Search ..... 604/289, 290, 292, 293; 2/158; 132/312; 15/208, 209 R, 227; 401/6-8; 433/89, 141-142; 493/194, 213

[56] References Cited

U.S. PATENT DOCUMENTS

| | | | |
|---|---|---|---|
| 2,998,880 | 9/1961 | Ladd | 206/363 |
| 3,004,698 | 10/1961 | Ashton | 229/62.5 |
| 4,181,069 | 1/1980 | Porter | 493/204 |
| 4,211,330 | 7/1980 | Strock | 15/227 |
| 4,347,931 | 9/1982 | Ginger et al. | 15/227 |
| 4,797,967 | 1/1989 | Lengers | 15/227 |

*Primary Examiner*—Stephen C. Pellegrino
*Assistant Examiner*—Michael Rafa
*Attorney, Agent, or Firm*—Cohn, Powell & Hind

[57] ABSTRACT

This applicator mitt includes an inner pouch and an outer pouch providing a cover for the inner pouch. The inner pouch includes an outer face receiving a treating substrance and is formed from a pair of panels, attached on two sides and one end and having separable margins on the other end to receive the hand portion of the user. The outer pouch can be a simple envelope or can be formed from a pair of panels attached to each other and to the inner pouch, said panels being removable to expose the inner pouch treating substance but remaining attached to the inner pouch during use.

6 Claims, 5 Drawing Sheets

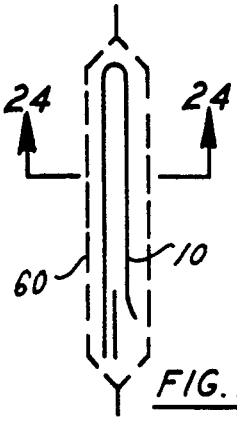
FIG. 19.
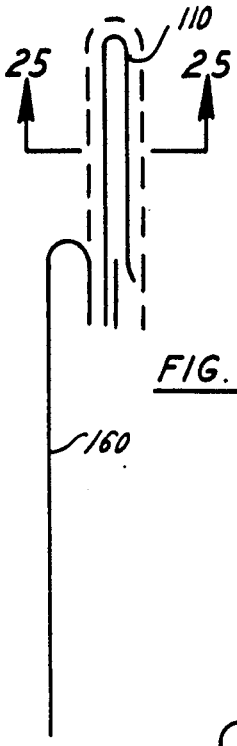
FIG. 20.
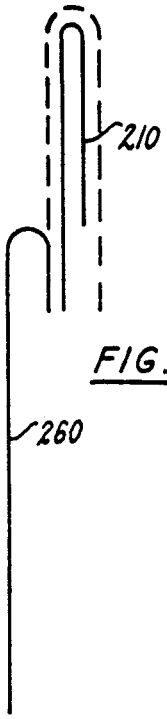
FIG. 21.
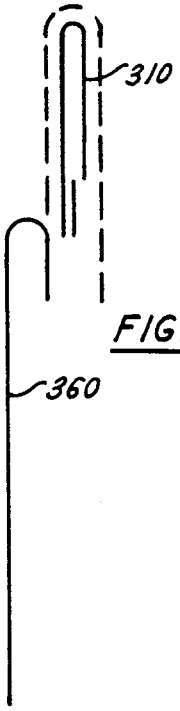
FIG. 22.
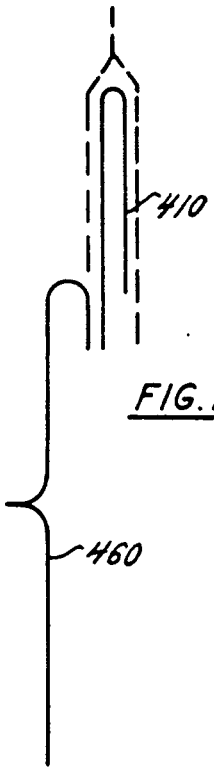
FIG. 23.
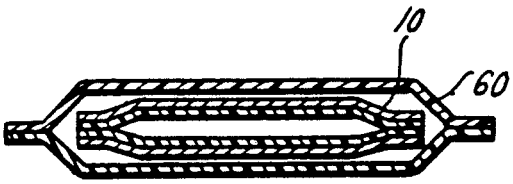
FIG. 24.
FIG. 25.
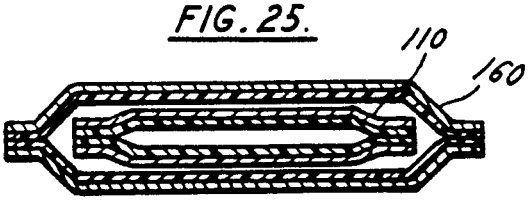

APPLICATOR MITT

This is a continuation in part of application Ser. No. 9,053, now abandoned.

BACKGROUND OF THE INVENTION

This invention relates generally to an applicator device and more particularly to a device in the nature of a treated mitt receiving a portion of the hand and having a protective cover removable to expose the treated portion of the mitt during use.

Applicator devices of the general type under consideration are used for applying medicament to various body portions and can be used, for example, for applying dentrifrice to the teeth of the user or ointment to injured parts of the user. They can also be used for the hand applicator of other treating substances, such as shoe polish, when it is desirable that such substances not come into contact with the skin of the user.

Applicators of this type provide that the treating substance is not exposed until ready for use and for this reason a combination package is provided in which an inner portion of the package, contains the treating substance on its outer face, and the inner portion is protected by an outer portion of the package, which can be removed so that the inner portion can receive the hand portion of the user and so that the treating substance can be exposed.

In particular, the applicator mitt which forms the subject matter of this invention represents an improvement over U.S. Pat. No. 3,608,566, U.S. Pat. No. 3,608,708, U.S. Pat. No. 3,675,264 issued to the present inventor and copending application Ser. No. 9,053 owned by the present inventor. The first of these patents discloses an applicator mitt having an inner pouch and an outer cover, which is opened by means of a tear strip to expose the inner pouch; the second patent discloses an applicator mitt formed from continuous inner and outer webs; and the third patent discloses an applicator mitt adapted to protect additional hand portions during use. The copending application discloses a means of preventing inadvertent blocking or sealing of the inner pouch opening by providing a heat seal resistant material in this area.

With applicator mitts of the above type heat and pressure sealing the inner and outer cover component parts represents a preferred method of construction. However, the particular structural arrangement of the component parts of such devices with the exception of that disclosed in the copending application has not been such as to facilitate this kind of manufacture on a mass production basis.

The present applicator device solves these and other problems in a manner not revealed in the known prior art.

SUMMARY OF THE INVENTION

This applicator mitt provides a disposable package unit having an improved sealing system which can be manufactured using a combination of sealing techniques, on a mass production basis.

This invention includes an inner pouch having a pair of overlying upper and lower panels each having an outer face and a heat sealable inner face, opposed side margins and opposed proximal and remote end margins, said panels being formed from a folded sheet to provide a common remote end margin, said upper panel being shorter than said lower panel to provide spaced proximal end margins, said side margins being heat sealed together for at least a portion of the length thereof and the spaced end margin of the upper panel being substantially free of attachment to the lower panel to provide a hand portion-receiving entry opening into said pouch, and to provide an outer pouch receiving said inner pouch.

It is an aspect of this invention to provide a separator strip having an upper face and a lower face, said lower face being heat sealed to the inner face of the lower panel and said strip being disposed in underlying relation to said inner pouch upper panel.

It is an aspect of this invention to provide that the lower panel is substantially longer than the upper panel to provide a gripping means which can be held between the uninserted hand portion and the palm of the hand.

Yet another aspect of this invention is to provide a separate seal intermediate and parallel to the side margin seals to divide the inner pouch into more than one compartment.

Another aspect of this invention is to provide that the inner pouch upper and lower panels are formed from a laminated plastic sheet including a first ply of nonwoven fabric providing said outer face, a second ply of plastic film providing said inner face and a third ply of extrusion coating sandwiched between said first and second plies.

It is an aspect of this invention to provide an outer pouch receiving said inner pouch, said outer pouch including a pair of overlying upper and lower panels, each panel having an outer face and a heat-sealable inner face, opposed side margins and opposed proximal and remote end margins, said side margins being heat sealed together for at least a portion of the length thereof and the inner face of the upper panel being operatively transversely heat sealed to the inner face of the lower panel of the inner pouch adjacent said proximal end margin and the inner face of the lower panel being operatively transversely heat sealed to the outer face of the lower panel of the inner pouch adjacent said proximal end margin.

Yet another aspect of this invention is to provide that the outer pouch transverse heat seal adjacent said proximal end margin is spaced from said proximal end margin of said upper panel to provide a liftable tab.

Another aspect of this invention is to provide a separator strip having an upper face and a lower face, said lower face being heat sealed to the inner face of the inner pouch lower panel and another aspect to provide a separator strip having said upper face heat sealed to the inner face of the outer pouch upper panel.

It is another aspect of this invention to provide that the outer pouch upper and lower panels are formed from a folded sheet to provide a common remote end margin.

Yet another aspect of this invention is to provide that the outer pouch upper and lower panels are formed from separate sheets heat sealed transversely at the remote ends thereof.

Still another aspect of this invention is to provide that the outer pouch upper and lower panels are formed from a laminated plastic sheet including a first ply of peel seal plastic film providing said outer face, a second ply of printable film providing said outer face and a third ply of support film sandwiched between said first and second plies.

Another aspect of this invention is to provide a method of constructing an applicator mitt comprising the steps of dispensing a web of material having first opposed margins defining opposed side portions, said web having a longitudinal axis disposed intermediate said margin; folding said side margins inwardly towards the longitudinal axis to define folded margins, the first margins being disposed in spaced relation from said folded margins and said longitudinal axis; cutting said folded web transversely at spaced intervals along the length thereof to form a plurality of individual sections having spaced transverse margins defining the width thereof; heat sealing said transverse margins for at least a portion of the length thereof to form a pair of open ended pouches; and slitting said individual sections along said longitudinal axis to form two separate pouches each having an upper panel and a lower panel said upper panel being shorter than said lower panel.

It is still another aspect of this invention to provide a method comprising the further steps of dispensing a relatively narrow web of material, having opposed margins disposed laterally inwardly of said longitudinal margins of said first web, and heat sealing said first and second webs together prior to folding so that the first web side portions overlap said second web following the folding process.

Yet another aspect of this invention is to provide a method comprising the further steps of dispensing a relatively wider web of material having first opposed margins defining opposed side margins, said web having a longitudinal axis disposed intermediate said margins; depositing said pair of open ended pouches onto said relatively wider web at spaced intervals; folding said side portions of said wider web inwardly towards said longitudinal axis to define folded margins, the first margins being disposed adjacent said longitudinal axis whereby said open ended pouch is sandwiched between said spaced end margins; heat sealing the open ended pouch, between said open ends to said sandwiching portions of said wider web; cutting said folded web transversely at spaced intervals along the length thereof greater than the width of said open-ended pouches; heat sealing said transverse margins for at least a portion of the length thereof to provide an outer pouch encapsulating said open ended pouches; and slitting said encapsulating pouch and said encapsulated pouches along said longitudinal axis to form two separate composite pouches.

Still another aspect of this invention is to provide a method including the further steps of dispensing a relatively wider web of material having first opposed margins defining opposed side margins, said web having a longitudinal axis disposed intermediate said margins; depositing said pair of open ended pouches onto said relatively wider web at spaced intervals; depositing a second relatively wider web of material having first opposed margins defining opposed side portions; said web having a longitudinal axis disposed intermediate said margins, onto said first web whereby said open-ended pouch is sandwiched between said spaced end margins; heat sealing said open-ended pouches between said open ends to said sandwiching portion of said wider web; cutting said folded web transversely at spaced intervals along the length thereof greater than the width of said open-ended pouches; heat sealing said transverse margins for at least a portion of the length thereof to provide an outer pouch encapsulating said open-ended pouches, and slitting said encapsulating pouch and said encapsulated pouches along said longitudinal axis to form two separate composite pouches.

Another aspect of this invention is to provide applicator mitts which are relatively inexpensive to manufacture by mass production methods, and which are easy to use by a consumer.

BRIEF DESCRIPTION OF THE DRAWINGS

FIGS. 19–23 are simplified views showing the use of the single and composite pouches;

FIG. 24 is a sectional view taken on line 24—24 of FIG. 19, and

FIG. 25 is a sectional view taken on lines 25—25 of FIGS. 20–23 prior to removal of the outer pouch.

DESCRIPTION OF THE PREFERRED EMBODIMENT

Figures 1, 2, 3, 4, 5, 6, 7:
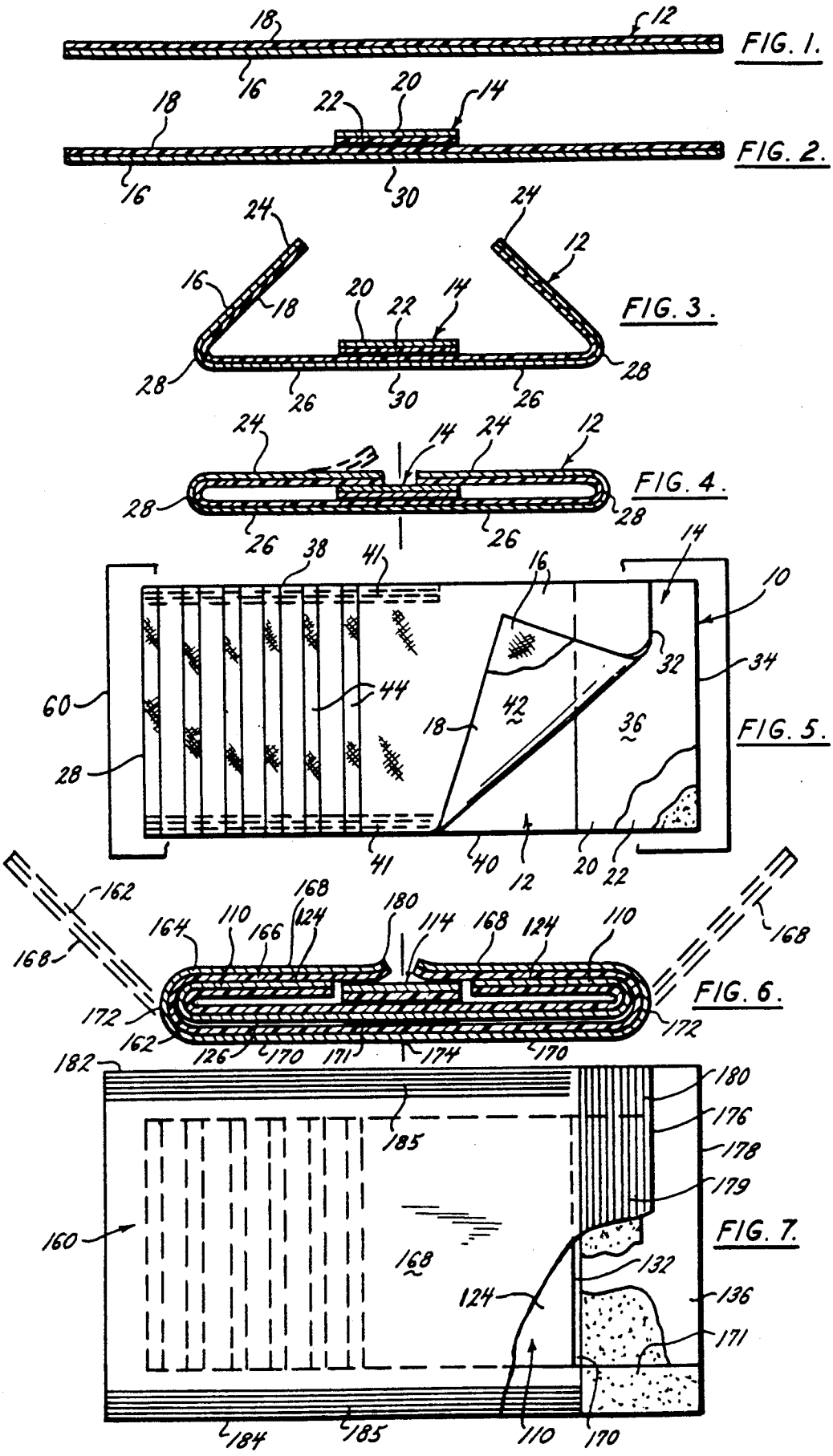
FIGS. 1–3 are cross sectional views showing progressive stages in the construction of the inner pouch shown in FIGS. 4 and 5.
FIG. 4 is a cross sectional view showing the completion of a double inner pouch.
FIG. 5 is a plan view of a single inner pouch.
FIG. 6 is a cross sectional view showing a pair of composite inner and outer pouches.
FIG. 7 is a plan view of one of the composite pouches of FIG. 6.

Referring now by reference numerals to the drawings and first to FIGS. 1–5, it will be understood that FIGS. 1–4 disclose the steps in the construction of the inner pouch 10 shown in FIG. 5. In the embodiment shown, a pair of inner pouches 10 are formed from a relatively long two ply laminated plastic film or sheet 12 and a relatively short two ply laminated plastic film or sheet 14. The short sheet can be dispensed with if desired as will be discussed below.

The first ply 16 of the laminated sheet 12 is of non-woven fabric and the second ply 18 is of thermoplastic film such as polyethylene or ethyl vinyl acetate (EVA), which is heat sealable to itself and to other plastic film such as the non-woven fabric forming the first ply 16. The first ply 20 of the laminated sheet 14 is a support film of polyester, paper, foil or the like, which can be printed on, or otherwise decorated, and the second ply 22 is of thermoplastic plastic film such as polyethylene or EVA.

As shown in FIG. 2 sheet 14 is heat sealed to the sheet 12 substantially at the midpoint 30 thereof corresponding to the longitudinal axis of said webs used to form the inner pouch in the preferred embodiment. As shown in FIGS. 3 and 4 sheet 12 is folded to provide upper panels 24 and lower panels 26 defined by common remote end margins 28 and, when separated at the midpoint 30, to define spaced proximal margins 32 and 34 respectively, as shown in FIG. 5. In the embodiment shown, the upper panel 24 overlaps the attached half portion of sheet 14 which provides a separator sheet indicated by numeral 36. The opposed side margins 38 of the upper panel 24 and the opposed side margins 40 of the lower panel 26 are in register and are heat sealed together by weld seal 41 for the greater portion of the length as shown by 41 to provide a flap 42 at the end of the upper panel which affords easy access for a hand portion such as the index finger which is receivable into the entry opening of the pouch 10. In the preferred embodiment the outer face of the upper and lower panels, formed from non-woven material is coated or impregnated with strips of material 44 such as dentrifrice so that the pouch provides an applicator mitt substitute for a toothbrush. The separator sheet 36 is not essential but provides a useful area for instructions or promotional material and also facilitates access to the pouch by inhibiting blocking. One or more of the pouches 10 may be contained within a sealed plastic envelope constituting an outer pouch indicated by numeral 60. This arrangement is shown schematically in FIG. 19. Alternatively, each inner pouch can be contained within its own individual outer pouch as will now be discussed with reference to FIGS. 6 and 7 in which similar parts are identified by the same numeral with the addition of a prefix "1".

As shown in FIGS. 6 and 7 the inner pouch 110 is identical to the inner pouch 10 except that the upper panel 124 is shorter than upper panel 24 described above with the result that proximal end margin 132 is spaced from the separator sheet 136 and said upper panel normally does not overlap said separator sheet 136.

The outer pouch 160 shown in FIG. 7 is one of a pair of outer pouches 160 formed from a relatively long two ply laminated plastic film or sheet 162. The first ply 164 of the laminated sheet 162 is of support film such as polyester, paper, foil, or the like, which can be printed on or otherwise decorated, and the second ply 166 is of thermoplastic film such as EVA which is heat and peel sealable to itself and to other film such as polyester, paper, foil and the like, forming the first ply 164.

As shown in FIG. 6 in phantom outline, sheet 162 is folded to provide upper panels 168 and lower panels 170 defined by common remote end margins 172 and, when separated at the midpoint 174, to define spaced proximal end margins 176 and 178 respectively. In the embodiment shown, the upper panel 168 overlaps the attached half portion of sheet 114 indicated by numeral 136 and is transversely heat sealed to said sheet 114 by peel seal 179. As clearly shown in FIG. 6 the seal is preferably stopped short of the upper panel proximal end margin so that a tab 180 is formed. The opposed side margins 182 of the upper panel 168 and the opposed side margins 184 of the lower panel 170 are in register and are heat sealed together by peel seals 185 so that the upper panel 168 can be peeled from the lower panel 170 is to expose the outer face of the inner pouch 110. In the embodiment shown the outer face of the inner pouch lower panel 126 is transversely heat sealed to the inner face of the outer pouch lower panel 170. This seal is preferably a weld seal 171 so that the inner pouch 110 remains attached to the outer pouch 160 as shown schematically in FIG. 20.

Figure 8:
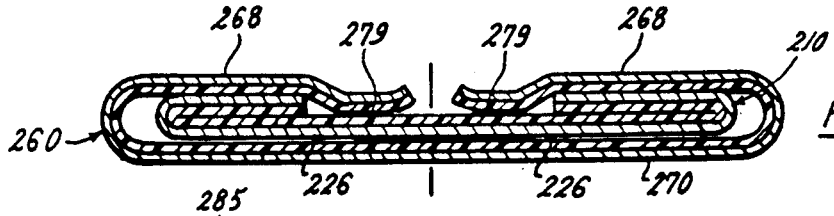
FIG. 8 is a cross sectional view showing a modified pair of inner and outer pouches.
Figure 9:
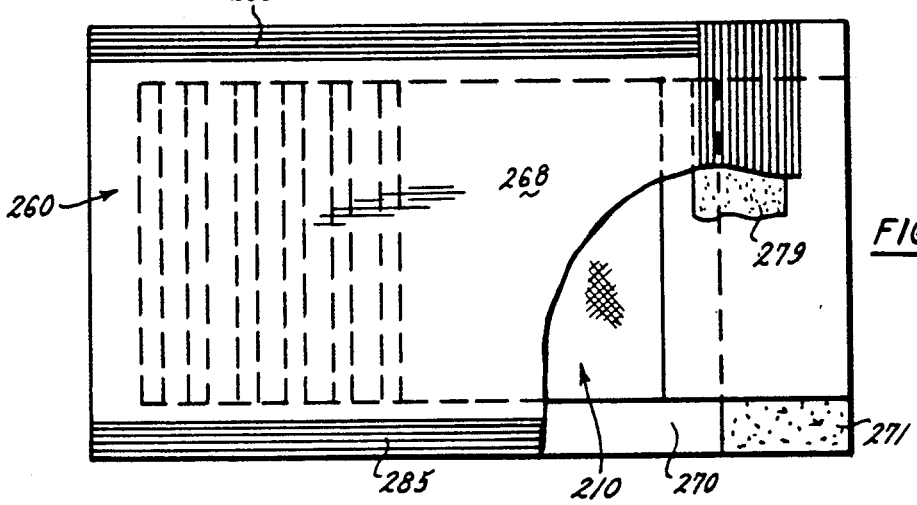
FIG. 9 is a plan view of one of the composite pouches of FIG. 8.

In the embodiment of the invention shown in FIGS. 8 and 9, the outer pouch 260 is substantially identical to that shown in FIGS. 6 and 7. The inner pouch 210 is similar to that shown in FIGS. 6 and 7 except that the short separator sheet is omitted. In this embodiment the inner face of the outer pouch upper panel 268 is transversely heat sealed directly to the inner face of the inner pouch lower panel 226 by peel seal 279. In other respects this embodiment is substantially identical to that shown in FIGS. 6 and 7. The use is demonstrated schematically in FIG. 21.

Figure 10:
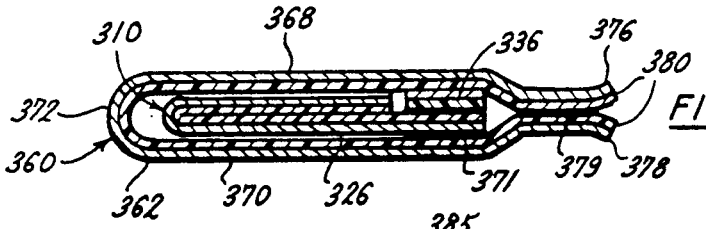
FIG. 10 is a cross sectional view showing a modified single composite pouch.
Figure 11:
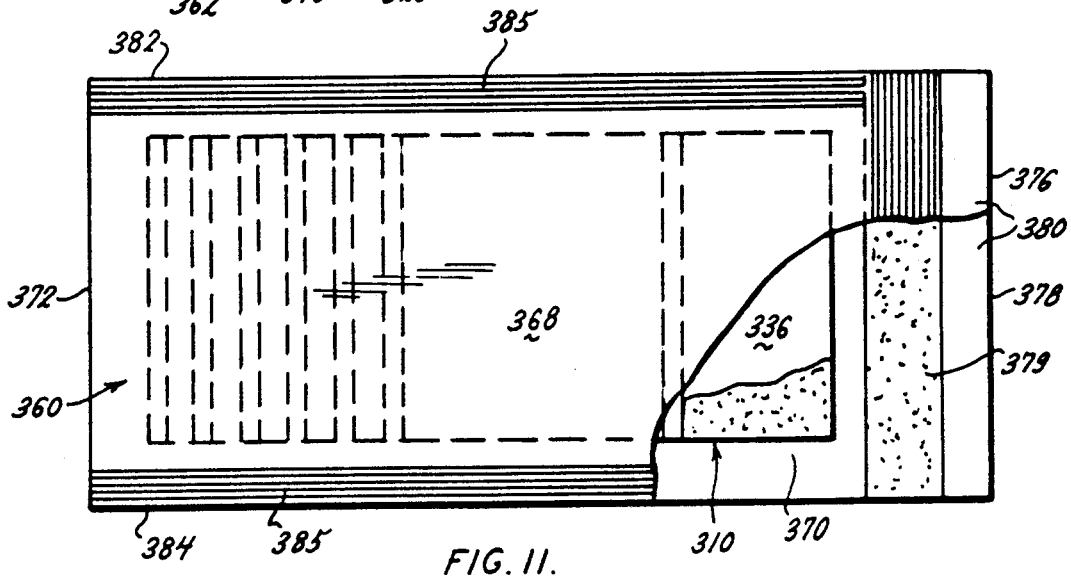
FIG. 11 is a plan view of the composite pouch of FIG. 10.

In the embodiment shown in FIGS. 10 and 11 the inner pouch 310 is substantially similar to inner pouch 110 shown in FIGS. 6 and 7 although the separator sheet 336 can be omitted if desired. However, the outer pouch 360 is substantially different in that it is formed initially as a single pouch rather than being formed initially as a double pouch The outer pouch 360 is formed from a folded sheet 362 to provide upper and lower panels 368 and 370, respectively defined by a common remote end margin 372 and coterminus proximal end margins 376 and 378. The upper and lower panels 368 and 370 are transversely heat sealed together by peel seal 379 at the proximal end and the seal is preferably stopped short of the margins to form tabs 380. The opposed side margins 382 of the upper panel 368 and the opposed side margins 384 of the lower panel 370 are heat sealed together by peel seals 385 and the outer face of the inner pouch lower panel 326 is transversely heat sealed to the inner face of the outer pouch lower panel 370 by weld seal 371. As will be observed the outer pouch lower panel 370 is longer than the inner pouch lower panel 326 so that the inner pouch 310 is completely enclosed.

Figure 12:
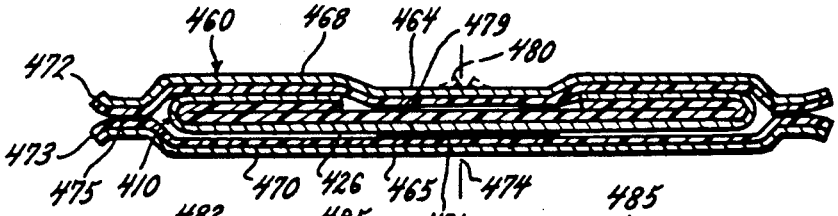
FIG. 12 is a cross sectional view showing another modified pair of composite inner and outer pouches.
Figure 13:
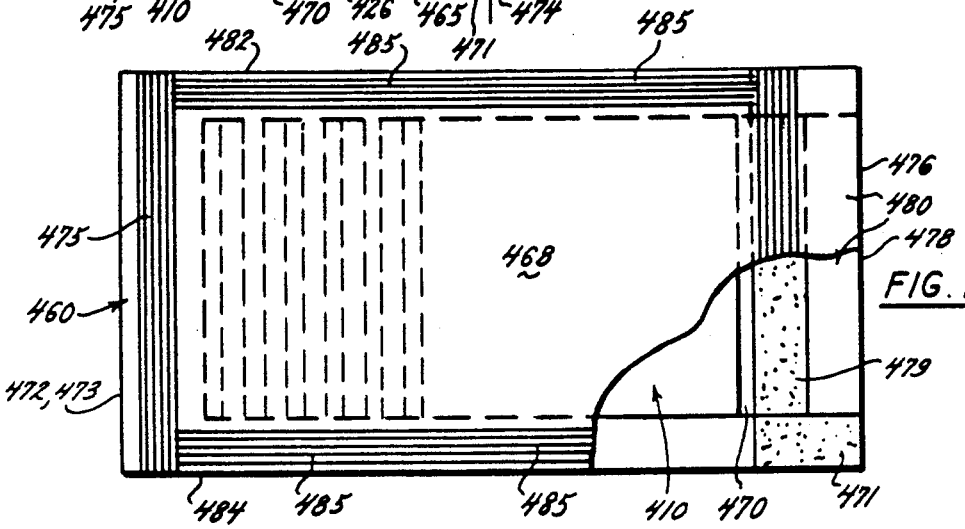
FIG. 13 is a plan view of one of the composite pouches of FIG. 12.

The embodiment shown in FIGS. 12 and 13 provides a different construction for the outer pouch 460 in that the upper and lower panels 468 and 470 are formed from two separate sheets 464 and 465. The inner pouch 410 is substantially similar to the inner pouch 210 shown in FIGS. 8 and 9. The outer pouch upper panel 468 and lower panel 470 each include remote end margins 472 and 473 which are transversely heat sealed together by weld seal 475 to provide a closed remote end. At the proximal end, when separated at the midpoint 474, the panels are defined by coterminus proximal end margins 476 and 478 respectively and the outer pouch panels are transversely heat sealed together adjacent to but short of said margins by peel seal 479 so that a tab 480 is formed. The opposed side margins 482 of the upper panel 468 and the opposed side margins of the lower panel 470 are in register and are heat sealed together by peel seals 485 so that the upper and lower panels can be peeled apart. The outer face of the inner pouch lower panel 426 is transversely heat sealed to the inner face of the outer pouch lower panel 470 by weld seal 471. The use is demonstrated schematically in FIG. 23.

Figure 14:
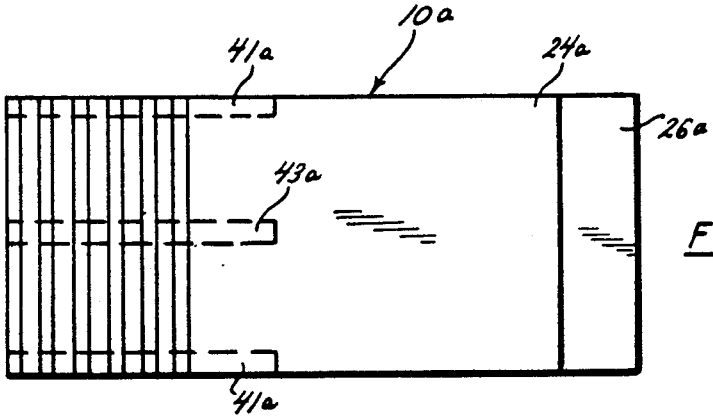
FIG. 14 is a plan view of a single inner pouch having multiple compartments.

The single modified pouch 10*a* shown in FIG. 14 is similar to pouch 10 shown in FIG. 5 except that the separator sheet is omitted. Pouch 10*a* distinguishes from pouch 10 in that a central seal 43*a* is provided between the upper and lower panels 24*a* and 26*a*. This arrangement provides dual chambers each of which receives a finger and enhances control of the pouch under some circumstances.

Figure 15:
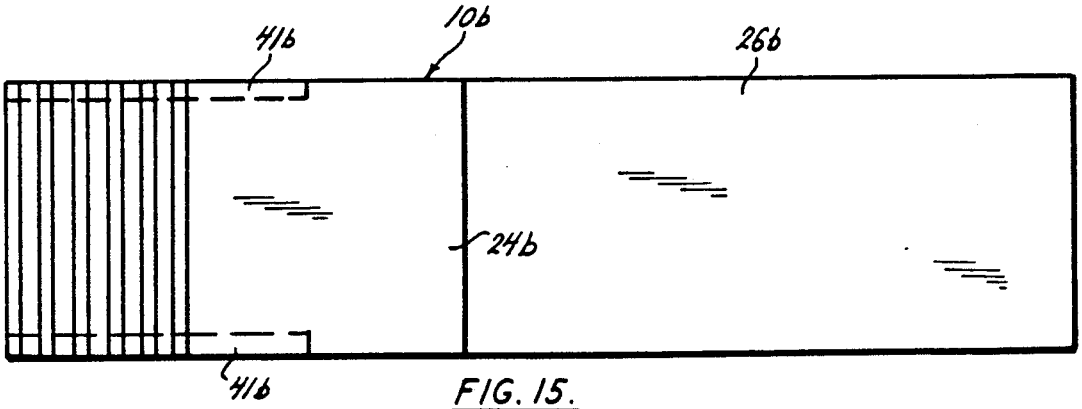
FIG. 15 is a plan view of a single inner pouch having a long lower panel.

The single modified pouch 10b shown in FIG. 15 is also similar to that shown in FIG. 5 except that again the separated sheet is omitted but also the lower panel 26b is considerably longer than the upper panel 24b. This structural arrangement of parts provides a pouch having a flap or handle which can be readily grasped between the uninserted fingers and the palm of the hand. This feature makes it particularly suitable for use in cleaning the teeth of pets.

The method by which the above applicator mitts are constructed will now be described.

Figure 16:
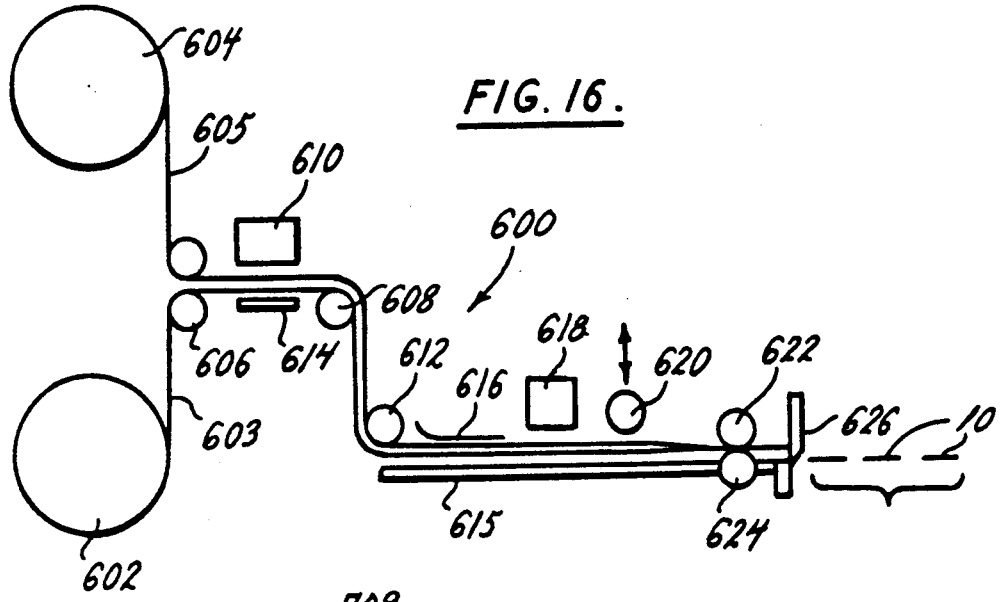
FIG. 16 is a schematic illustrating the method of construction an inner pouch.

The method of forming the inner pouch is best understood by reference to FIG. 16 which illustrates schematically a packaging machine 600, constituting an inner pouch forming apparatus. The packaging machine 600 includes a pair of web dispensing rolls 602 and 604 which dispense a relatively wide web 603 and a relatively narrow web 605 respectively. The webs 603 and 605 pass over idler rollers 606 and 608. At roller 606 the webs are disposed in overlying relation with the narrow web 605 disposed centrally on the wide web 603. Between the rollers 606 and 608 the webs are subjected to heat sealing at heat sealing station 610 disposed above a machine base 614. From roller 608 the heat sealed webs pass under idler roller 612 above a machine base 615 and below a folding station 616 where the web 603 is folded as shown in FIG. 3. From the folding station 616 the composite folded web is passed below a second heat sealing station 618 where the folded sides of the web panels are sealed transversely to form longitudinally spaced seal lines indicated by numeral 41 in FIG. 5. The transversely sealed composite web sections are passed through a slitter station 620 where the composite web is longitudinally slit to separate it into two web portions proceeding in side-by-side relation under the action of pull rollers 622 and 624. The separated webs move under the action of the pull rollers 622 and 624 into the vicinity of cutting station 626 where they are separated into a plurality of separate sections 10 having the configuration shown in FIG. 5.

Figure 17:
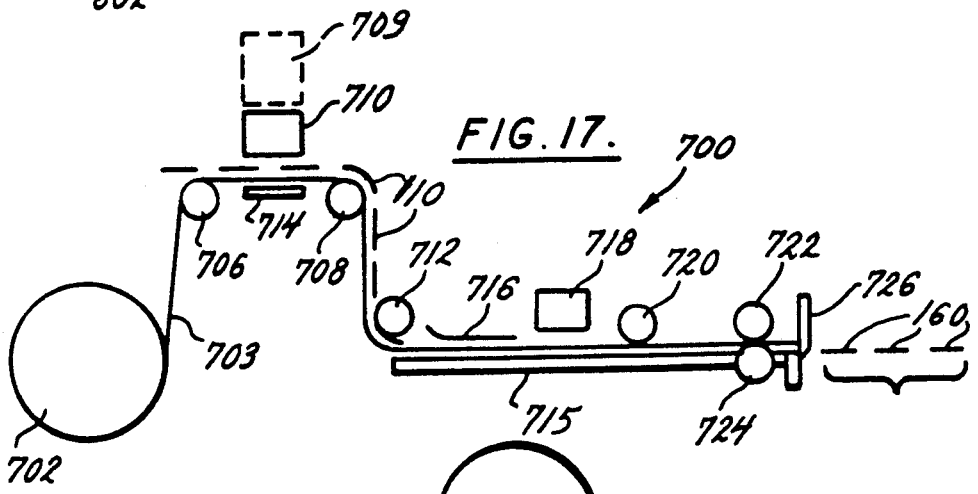
FIG. 17 is a schematic showing the construction of a composite pouch.

The separate sections 10 provide inner pouches which can be packaged individually, or in packs of several pouches, into a conventional plastic envelope 60. Alternatively, the longitudinal slitter 620 can be dispensed with so that the double inner pouches proceed along the conveyor line to a second stage of the packaging machine indicated by numeral 700. This stage of the operation is shown in FIG. 17.

The second stage provides that an underlying web 703 is dispensed from a roll 702 over an idler roll 706. From the idler roller 706 the inner pouches are fed onto the underlying web and at heat sealing station 710 are heat sealed to said web 703. The movement of said pouches can be controlled as by air suction. Alternatively, the separated sections 10 can be collected, loaded into magazine 709 and deposited at predetermined intervals onto said underlying web 703 and heat sealed to said web 703 at heat sealing station 710. In any event, with the inner pouches in place, the web 703 is then passed over idler rollers 708 and 712 and directed toward an enfolding station 716. Following enfoldment the web and the inner pouches are passed through transverse heat sealing station 718 where the margin portions are sealed to the intermediate portion of the inner pouch. From station 718 the combined web is slit longitudinally at slitter station 720 to separate them into two composite longitudinal web portions proceeding in side-by-side relation under the action of pull rollers 722 and 724. As they emerge from the pull rollers 722 and 724 they pass to the final cutt-off or transverse slitter station 726 where they are separated into a plurality of combination pouches 160 having the configuration shown in FIGS. 6 and 7.

Figure 18:
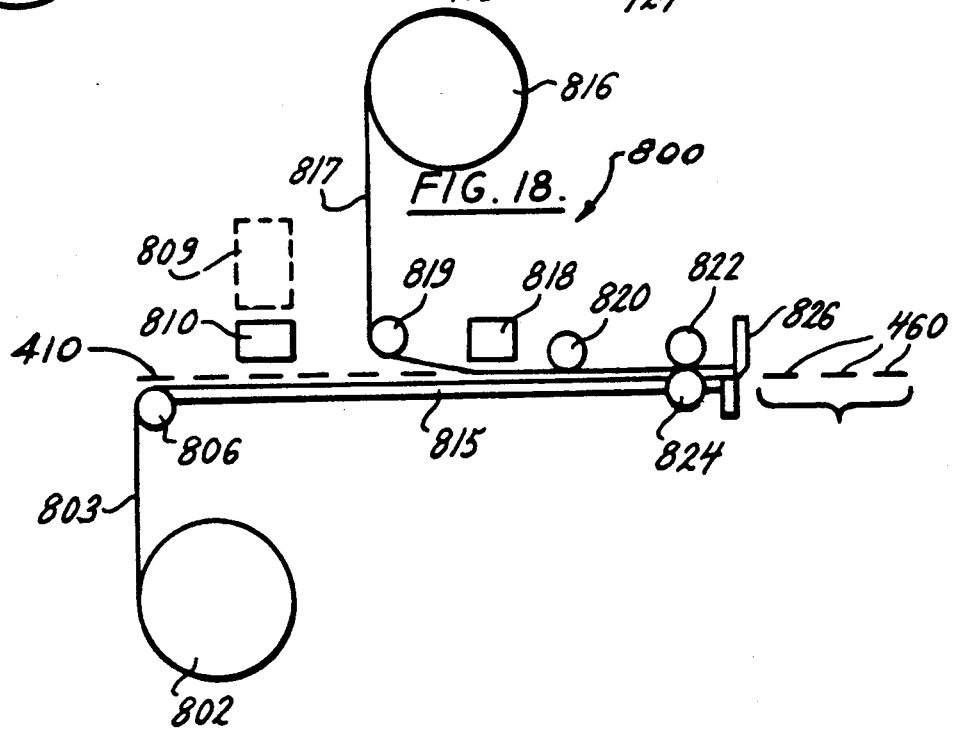
FIG. 18 is a schematic showing the construction of a modified composite pouch.

An alternative method of forming the outer pouch is illustrated in FIG. 18 which illustrates a packaging machine 800. In this method, in lieu of enfolding of the web 703, a web 803 slightly wider than the inner pouch 10, is utilized. An overlying web 817 having the same width as web 803 is dispensed from a roll 816 over an idler roll 819. The inner pouches 410 are sequentially fed onto web 803 and heat sealed into position at heat sealing station 810. Said pouches move forward and are fed between the underlying and overlying webs 803 and 817 respectively. From roller 819 the double inner pouches, now sandwiched between the webs 803 and 815, pass to the heat sealing station 818 for longitudinal sealing along the web margins. The webs 803 and 817 are passed through slitter station 820 where the webs are longitudinally slit together with the spaced inner pouch sections, to separate them into two composite longitudinal web portions proceeding in side-by-side relation under the action of upper and lower pull rollers 822 and 824 following which they are separated at transverse slitter station 826 into a plurality of separate combination pouches 460 having the configuration shown in FIGS. 12 and 13. Alternatively, as discussed above with respect to the second stage of the packaging machine, the separated sections from magazine 810 onto said web 803.

I claim as my invention:

1. A packaged applicator mitt formed from two laminated elongated sheets, the first laminated sheet including a first ply of a non-woven fabric layer, and, as a second ply bonded thereto, a thermoplastic film, the second laminated sheet being wider than the first sheet and including, as a first ply, a support layer capable of being printed on, and, as a second ply bonded thereto, a thermoplastic film, the first laminated sheet being folded with the fabric layer out and a portion of the sides thereof weld sealed to form an inner pouch, the wider second sheet being folded around the pouch so formed with the backing printable layer out, and the sides thereof peel sealed to form an outer pouch, the nonfolded open end of the outer pouch peel sealed forming an inner pouch sealed-in within the outer pouch.

2. An applicator mitt as defined in claim 1, wherein a separate seal is provided intermediate and parallel to the side margins to divide the inner pouch into more than one compartment.

3. The applicator mitt of claim 1 wherein the fold of the inner pouch is such that the open ends of the inner pouch are offset.

4. A packaged applicator mitt formed from two laminated elongated sheets, the first laminated sheet including a first ply of a non-woven fabric layer, and, as a second ply bonded thereto, a thermoplastic film, the second laminated sheet being wider than the first sheet and including, as a first ply, a support layer capable of being printed on, and, as a second ply bonded thereto, a thermoplastic film, the first laminated sheet being folded with the fabric layer out and a portion of the sides thereof weld sealed to form an inner pouchy, the wider second sheet being folded around the pouch so formed with the backing printable layer out, and the sides thereof peel sealed to form an outer pouch, an end of one fold of the outer pouch being weld sealed to an end of one fold of the inner pouch, the outer pouch becoming a handle when unpeeled from outside the inner pouch.

5. The applicator mitt of claim 1 wherein the fold of the inner pouch is such that the open ends of the inner pouch are offset, with a longer end and a shorter end.

6. The applicator mitt of claim 5 wherein one fold of the outer pouch is transversely heat welded to the longer open end of the inner pouch, affording a handle when unpeeled from outside the inner pouch.

* * * * *